US010997818B2

(12) United States Patent
Pinder et al.

(10) Patent No.: US 10,997,818 B2
(45) Date of Patent: *May 4, 2021

(54) METHODS AND SYSTEMS FOR INTERACTING WITH A PLAYER USING A GAMING MACHINE

(71) Applicant: Video Gaming Technologies, Inc., Franklin, TN (US)

(72) Inventors: Jennifer Pinder, Franklin, TN (US); William Douglas Lamb, Eagleville, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/705,548

(22) Filed: Dec. 6, 2019

(65) Prior Publication Data

US 2020/0118384 A1 Apr. 16, 2020

Related U.S. Application Data

(63) Continuation of application No. 14/497,761, filed on Sep. 26, 2014, now Pat. No. 10,504,323.

(51) Int. Cl.
*G07F 17/32* (2006.01)

(52) U.S. Cl.
CPC ..... *G07F 17/3225* (2013.01); *G07F 17/3209* (2013.01); *G07F 17/3213* (2013.01); *G07F 17/3216* (2013.01)

(58) Field of Classification Search
CPC ..... G07F 17/3225; G07F 17/3209; G07F 17/3213; G07F 17/3216
See application file for complete search history.

(56) References Cited

U.S. PATENT DOCUMENTS

| | | | |
|---|---|---|---|
| 7,764,026 | B2 | 7/2010 | Dowling et al. |
| 8,157,650 | B2 | 4/2012 | Grant et al. |
| 2007/0287544 | A1 | 12/2007 | Hirato |
| 2008/0113821 | A1 | 5/2008 | Beadell |
| 2008/0194175 | A1 | 8/2008 | Last et al. |
| 2010/0016075 | A1 | 1/2010 | Thomas |
| 2012/0129601 | A1 | 5/2012 | Gronkowski et al. |
| 2013/0154914 | A1 | 6/2013 | Salo et al. |
| 2013/0337889 | A1 | 12/2013 | Gagner et al. |
| 2014/0073409 | A1 | 3/2014 | Lesley et al. |
| 2014/0282051 | A1 | 9/2014 | Cruz-Hernandez et al. |

(Continued)

OTHER PUBLICATIONS

Garmin Forerunner 405 "Owner's Manual" copyright Jan. 2009 Garmin LTD. or its subsidiaries https://www.youtube.com/watch?v=zS2KgVaITTs.

(Continued)

*Primary Examiner* — Werner G Garner
(74) *Attorney, Agent, or Firm* — Armstrong Teasdale LLP

(57) ABSTRACT

A gaming system includes a frame, a gaming machine coupled to the frame, and an interactive device extending about at least a portion of a periphery of the frame. The gaming machine includes a presentation device configured to present a message associated with an interaction of a player with the gaming system. The interactive device is configured to detect the interaction of the player with the interactive device, and present feedback to the player based on the detection of the interaction of the player with the interactive device.

20 Claims, 11 Drawing Sheets

(56) References Cited

U.S. PATENT DOCUMENTS

| | | | |
|---|---|---|---|
| 2015/0205400 | A1 | 7/2015 | Hwang et al. |
| 2016/0188181 | A1 | 6/2016 | Smith et al. |

OTHER PUBLICATIONS

Office Action dated Nov. 20, 2020 for U.S. Appl. No. 16/705,561 (pp. 1-7).
Office Action dated Jan. 13, 2021 for U.S. Appl. No. 16/705,557 (pp. 1-7).

METHODS AND SYSTEMS FOR INTERACTING WITH A PLAYER USING A GAMING MACHINE

CROSS-REFERENCE TO RELATED APPLICATIONS

This application is a continuation of and claims the benefit of priority to U.S. patent application Ser. No. 14/497,761, filed 26 Sep. 2014, entitled "METHODS AND SYSTEMS FOR INTERACTING WITH A PLAYER USING A GAMING MACHINE," the entire contents and disclosures of which are hereby incorporated herein by reference in their entirety.

BACKGROUND

The field of the disclosure relates generally to gaming machines, and, more particularly, to methods and systems for interacting with a player using a gaming machine.

Although playing a game of chance is typically fun, the general aspects of risk may make the overall experience both exciting and stressful at the same time. As such, attempts to conjure good luck may be very common among players. User experiences based on at least some known rituals and/or devices used to conjure good luck, however, are user-generated and are independent of the gaming system.

BRIEF SUMMARY

In one aspect, a method is provided for interacting with a player using a gaming machine including a presentation device. The method includes presenting, at the presentation device, a message associated with an interaction of the player with a gaming system including a frame and an interactive device extending about at least a portion of a periphery of the frame, detecting, at the interactive device, the interaction of the player with the interactive device, and presenting, at the interactive device, feedback to the player based on the detection of the interaction of the player with the interactive device.

In another aspect, a gaming system is provided. The gaming system includes a frame, a gaming machine coupled to the frame, and an interactive device extending about at least a portion of a periphery of the frame. The gaming machine includes a presentation device configured to present a message associated with an interaction of a player with the gaming system. The interactive device is configured to detect the interaction of the player with the interactive device, and present feedback to the player based on the detection of the interaction of the player with the interactive device.

In yet another aspect, one or more computer-readable storage media having computer-executable instructions embodied thereon is provided. When executed by at least one processor, the computer-executable instructions cause the processor to present, at a presentation device, a message associated with an interaction of a player with a gaming system including a frame, a gaming machine including the presentation device, and an interactive device extending about at least a portion of a periphery of the frame, identify an interaction of the player with the interactive device, and present, at the interactive device, feedback to the player based on the identification of the interaction of the player with the interactive device.

The features, functions, and advantages described herein may be achieved independently in various embodiments of the present disclosure or may be combined in yet other embodiments, further details of which may be seen with reference to the following description and drawings.

BRIEF DESCRIPTION OF THE DRAWINGS

FIG. 1 is a schematic diagram of an example gaming system including a frame, a gaming machine that includes a presentation device, and an interactive device;

FIG. 2 is a schematic block diagram of an example computer system that may be used to operate the gaming system shown in FIG. 1;

FIG. 3 is a flowchart of an example method for interacting with a player using the computer system shown in FIG. 2; and FIG. 4 is an example image that may be shown on the presentation device shown in FIG. 1 at a first stage of interaction with a player of the gaming machine shown in FIG. 1;

FIGS. 5 and 6 are schematic diagrams of the gaming system shown in FIG. 1 at various stages of interaction with the player;

FIG. 7 is an example image that may be shown on the presentation device shown in FIG. 1 at another stage of interaction with the player;

FIGS. 8 and 9 are schematic diagrams of the gaming system shown in FIG. 1 at various stages of interaction with the player;

FIG. 10 is an example image that may be shown on the presentation device shown in FIG. 1 at yet another stage of interaction with the player; and FIG. 11 is a schematic diagram of the gaming system shown in FIG. 2 including another interactive device.

Figure 1:
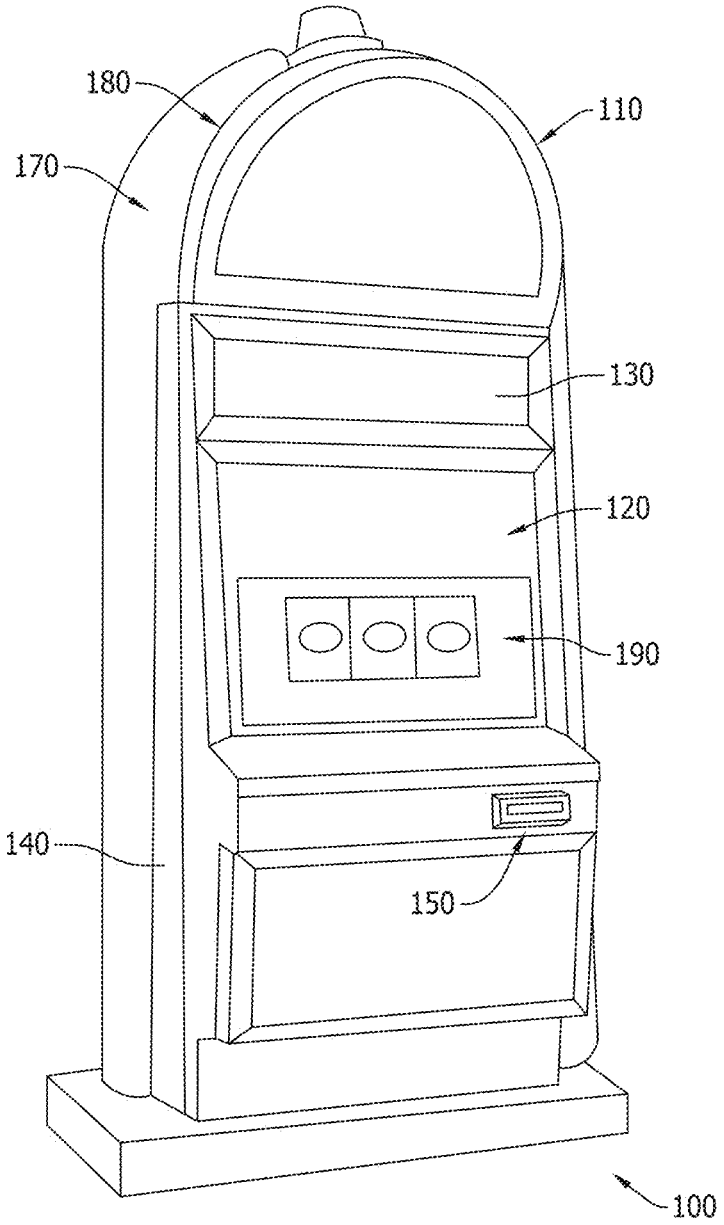
FIGS. 1-11 show example embodiments of the method and system described herein.

Although specific features of various embodiments may be shown in some drawings and not in others, such illustrations are for convenience only. Any feature of a drawing may be referenced and/or claimed in combination with any feature of any other drawing. Corresponding reference characters indicate corresponding parts throughout the several views of the drawings.

DETAILED DESCRIPTION

Example embodiments of systems and methods for interacting with a user and/or a potential user of a gaming machine are described herein. In one embodiment, a gaming system includes a frame, a gaming machine coupled to the frame, and an interactive device extending about at least a portion of a periphery of the frame. The gaming machine includes a presentation device that presents a message associated with an interaction of a player with a gaming system, and the interactive device detects the interaction of the player with the interactive device, and presents feedback to the player based on the detection of the interaction of the player with the interactive device.

The methods and systems described herein may be implemented using computer programming or engineering techniques including computer software, firmware, hardware, or any combination or subset thereof, wherein the technical effects may be achieved by performing at least one of the following steps: (a) presenting, at a presentation device, a message associated with an interaction of a player with a gaming system; (b) identifying the interaction of the player with an interactive device; (c) generating a gaming event; (d) determining whether the interaction of the player with the interactive device satisfies a predetermined threshold; (e) identifying an absence of the interaction of the player with an interactive device; and (f) presenting, at the interactive device, feedback to the player.

The following detailed description illustrates embodiments of the disclosure by way of example and not by way of limitation. It is contemplated that the disclosure has application to interactive methods and systems, in general, to increase interactivity with and/or engagement of a user to facilitate increasing an enjoyment and/or satisfaction associated with the experience.

An element or step recited in the singular and preceded with the word "a" or "an" should be understood as not excluding plural elements or steps unless such exclusion is explicitly recited. Moreover, references to an "example embodiment" or "one embodiment" are not intended to be interpreted as excluding the existence of additional embodiments that also incorporate the recited features.

FIG. 1 is a schematic diagram of an example gaming system 100 including a cabinet or frame 110, and a gaming machine 120 coupled to frame 110. In the example embodiment, frame 110 includes a wall 130 having an outer surface 140 that defines a periphery and an inner surface (not shown) that defines a cavity (not shown).

In the example embodiment, gaming machine 120 includes a bill acceptor 150 for accepting and/or validating cash bills, coupons, and/or ticket vouchers. Furthermore, in some embodiments, bill acceptor 150 includes a card reader or validator for use with credit cards, debit cards, identification cards, and/or smart cards. The cards accepted by bill acceptor 150 may include a magnetic strip and/or a preprogrammed microchip that includes a player's identification, credit totals, and any other relevant information that may be used. In one embodiment, bill acceptor 150 is capable of printing tickets.

In the example embodiment, gaming system 100 includes and/or is coupled to a computing device 160 (shown in FIG. 2) that is programmed to control and/or determine at least some functions and/or operations associated with gaming machine 120. For example, in one embodiment, gaming machine 120 is configured to generate at least one gaming event. "Gaming event" may refer to one or more events associated with gaming machine 120 including, without limitation, a game start, a win, a loss, a number of consecutive wins, a number of consecutive losses, a number of credits awarded, a number of credits lost, a close win, and a close loss.

In one embodiment, gaming machine 120 randomly generates game outcomes using probability data. For example, each game outcome is associated with one or more probability values that are used by gaming machine 120 to determine the game output to be displayed. Such a random calculation may be provided by a random number generator, such as a true random number generator (RNG), a pseudorandom number generator (PNG), or any other suitable randomization process. Gaming machine 120 may be any type of gaming machine, and may include, without limitation, different structures than those shown in FIG. 1. Moreover, gaming machine 120 may employ different methods of operation than those described below. For example, in the example embodiment, gaming machine 120 is a "Mr. Money Bags™' Mega-Buck$ Mansion" game. (Mr. Money Bags is a registered trademark of Video Gaming Technologies, Inc., Franklin, Tenn.).

In the example embodiment, gaming system 100 includes an interactive device 170 extending about at least a portion 180 of the periphery of frame 110. More specifically, in the example embodiment, interactive device 170 is coupled to outer surface 140 and extends at least substantially along a left side, a top, and/or a right side of frame 110. Alternatively, interactive device 170 may be coupled to and/or in any position with respect to any portion of frame 110 and/or gaming machine 120 that enables gaming system 100 to function as described herein.

In the example embodiment, interactive device 170 is sensitive to user input and/or is configured to be stimulated by an interaction of a player and/or a potential player of gaming machine 120 with interactive device 170. More specifically, in the example embodiment, interactive device 170 is configured to identify and/or detect an interaction of the player with interactive device 170, and present feedback to the player based on the detection of the interaction of the player with interactive device 170. As used herein, "feedback" refers to any information presented based on an interaction (or lack thereof) including, but not limited to tactile feedback (e.g., vibrations), audible feedback (e.g., noises), and/or visual feedback (e.g., lights). In the exemplary embodiment, interactive device 170 is configured to detect a tactile and/or an audible interaction. Alternatively, interactive device 170 may be configured to detect any type of interaction that enables gaming system 100 to function as described herein.

In some embodiments, interactive device 170 is configured to detect and/or identify an absence of an interaction of the player with interactive device 170, and present feedback to the player when the absence is identified. For example, in at least some embodiments, interactive device 170 is configured to be in and/or change towards a first configuration 510 (e.g., a first color) when the player does not interact with interactive device 170, and be in and/or change towards a second configuration 520 (e.g., a second color) when the player interacts with interactive device 170.

In the example embodiment, interactive device 170 is configured to be stimulated by at least one of a number of stimulations and/or triggering events. In some embodiments, interactive device 170 is coupled to computing device 160, such that at least some functions and/or operations associated with computing device 160 are controlled and/or determined based on a function and/or operation of interactive device 170 and/or at least some functions and/or operations associated with interactive device 170 is controlled and/or determined by computing device 160. In some embodiments, interactive device 170 is configured to determine whether an interaction of the player with interactive device 170 satisfies a predetermined threshold and/or present feedback to the player when the predetermined threshold is satisfied. In some embodiments, interactive device 170 is configured to detect and/or identify a generation of a gaming event and/or present feedback to the player when the gaming event is generated.

In the example embodiment, gaming machine 120 includes a presentation device 190 that is coupled to computing device 160, such that at least some functions and/or operations associated with presentation device 190 is controlled and/or determined by computing device 160. Presentation device 190 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user. For example, in the example embodiment, presentation device 190 is a touch screen device.

In the example embodiment, presentation device 190 is used to display one or more game images, symbols, and/or indicia such as a visual representation or exhibition of movement of an object (e.g., a mechanical, virtual, or video reel), dynamic lighting, video images, and the like. In an alternative embodiment, presentation device 190 displays images and indicia using mechanical means. For example, presentation device 190 may include an electromechanical device, such as one or more rotatable reels, to display a plurality of game or other suitable images, symbols, or indicia.

In the example embodiment, presentation device 190 is configured to present a message to the player. For example, in the example embodiment, presentation device 190 is configured to present a message associated with an interaction of the player with gaming system 100. More specifically, in the example embodiment, the message prompts the player to initiate a game on gaming machine 120 and/or and interact with interactive device 170. Additionally or alternatively, the message provides feedback to the player based on the identification and/or detection of the initiation of the game on gaming machine 120 and/or interaction of the player with interactive device 170. In some embodiments, the message provides feedback to the player based on the identification and/or detection of an absence of an initiation of a game on gaming machine 120 and/or interaction of a player with interactive device 170. In some embodiments, the message provides feedback to the player based on a generation of a gaming event. In some embodiments, presentation device 190 is configured to present feedback to the player when a predetermined threshold is satisfied.

Figure 2:
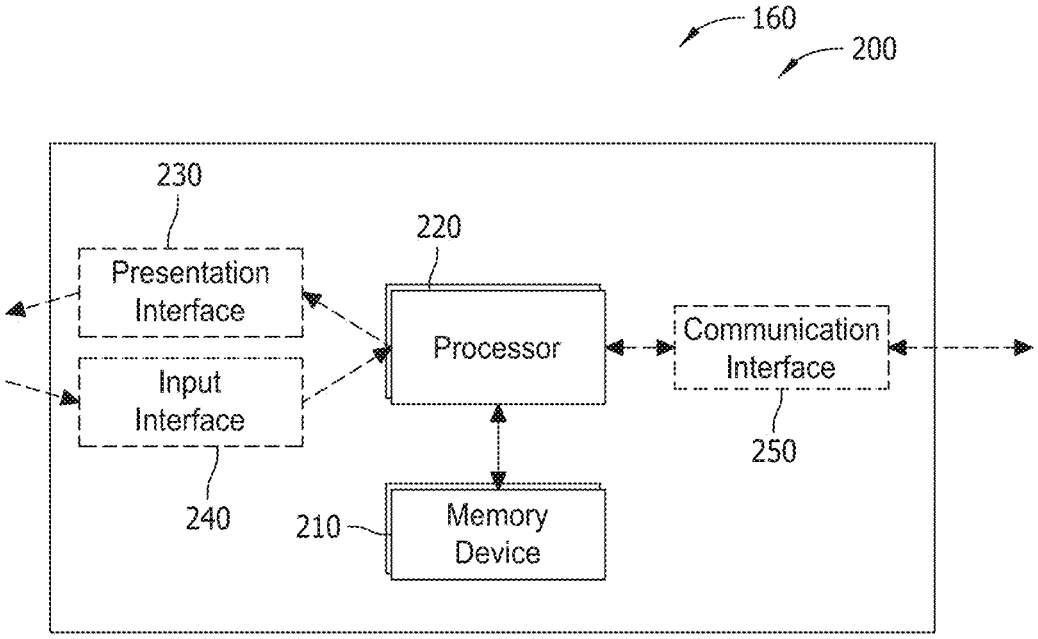

FIG. 2 is a schematic block diagram of computer system 200, such as computing device 160. In the example embodiment, computer system 200 includes a memory device 210 and a processor 220 coupled to memory device 210 for use in executing instructions. More specifically, in the example embodiment, computer system 200 is configurable to perform one or more operations described herein by programming memory device 210 and/or processor 220. For example, processor 220 may be programmed by encoding an operation as one or more executable instructions and by providing the executable instructions in memory device 210.

Processor 220 may include one or more processing units (e.g., in a multi-core configuration). As used herein, the term "processor" is not limited to integrated circuits referred to in the art as a computer, but rather broadly refers to a controller, a microcontroller, a microcomputer, a programmable logic controller (PLC), an application specific integrated circuit, and other programmable circuits.

In the example embodiment, memory device 210 includes one or more devices (not shown) that enable information such as executable instructions and/or other data to be selectively stored and retrieved. In the example embodiment, such data may include, but is not limited to, gaming information, operational data, and/or control algorithms. In the example embodiment, computer system 200 is configured to interact with the player of gaming machine 120. Alternatively, computer system 200 may use any algorithm and/or method that enable the methods and systems to function as described herein. Memory device 210 may also include one or more computer readable media, such as, without limitation, dynamic random access memory (DRAM), static random access memory (SRAM), a solid state disk, and/or a hard disk.

In the example embodiment, computer system 200 includes a presentation interface 230 that is coupled to processor 220 for use in presenting information to a user. For example, presentation interface 230 may include a display adapter (not shown) that may couple to a display device (not shown), such as, without limitation, a cathode ray tube (CRT), a liquid crystal display (LCD), a light-emitting diode (LED) display, an organic LED (OLED) display, an "electronic ink" display, and/or a printer. In some embodiments, presentation interface 230 includes one or more display devices.

Computer system 200, in the example embodiment, includes an input interface 240 for receiving input from the user. For example, in the example embodiment, input interface 240 receives information suitable for use with the methods described herein. Input interface 240 is coupled to processor 220 and may include, for example, a joystick, a keyboard, a pointing device, a mouse, a stylus, a touch sensitive panel (e.g., a touch pad or a touch screen), and/or a position detector. It should be noted that a single component, for example, a touch screen, may function as both presentation interface 230 and as input interface 240.

In the example embodiment, computer system 200 includes a communication interface 250 that is coupled to processor 220. In the example embodiment, communication interface 250 communicates with at least one remote device, such as another computer system 200. For example, communication interface 250 may use, without limitation, a wired network adapter, a wireless network adapter, and/or a mobile telecommunications adapter. A network (not shown) used to couple computer system 200 to the remote device may include, without limitation, the Internet, a local area network (LAN), a wide area network (WAN), a wireless LAN (WLAN), a mesh network, and/or a virtual private network (VPN) or other suitable communication means.

Figure 3:
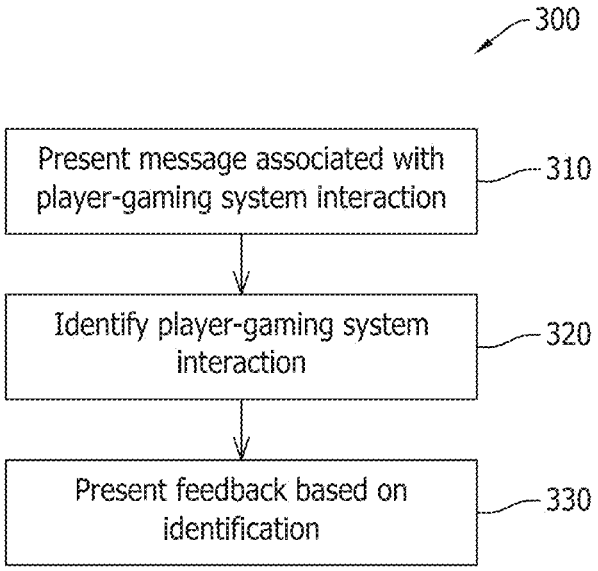

FIG. 3 is a flowchart of an example method 300 for interacting with the player of gaming machine 120. In the example embodiment, a player and/or a potential player approaches a gaming machine 120, which presents 310, via presentation device 190, a message associated with an interaction of the player with gaming system 100. For example, in one embodiment, presentation device 190 prompts the player to interact with interactive device 170. Additionally or alternatively, presentation device 190 prompts the player to initiate a game on gaming machine 120.

In the example embodiment, the interaction of the player with interactive device 170 is identified 320, and feedback is presented 330, via interactive device 170, to the player based on the identification 320. In at least some embodiments, an absence of the interaction is identified 320, and feedback is presented 330, via interactive device 170, to the player based on the absence of the interaction. In at least some embodiments, a gaming event is generated, and feedback is presented 330, via interactive device 170 and/or presentation device 190 to the player based on the gaming event. In at least some embodiments, it is determined whether the interaction satisfies a predetermined threshold, and feedback is presented 330, via interactive device 170 and/or presentation device 190 to the player based on the determination.

Figure 4:
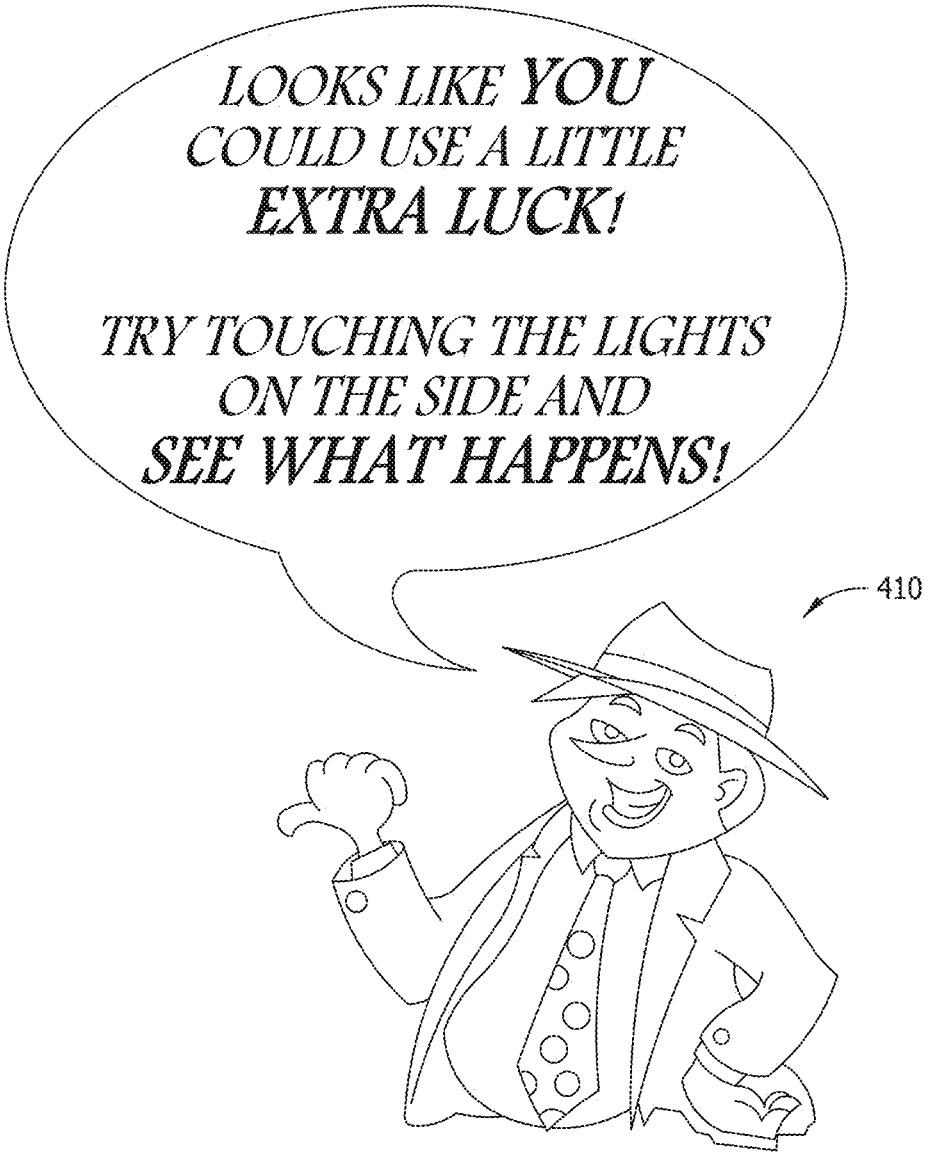
Figure 5:
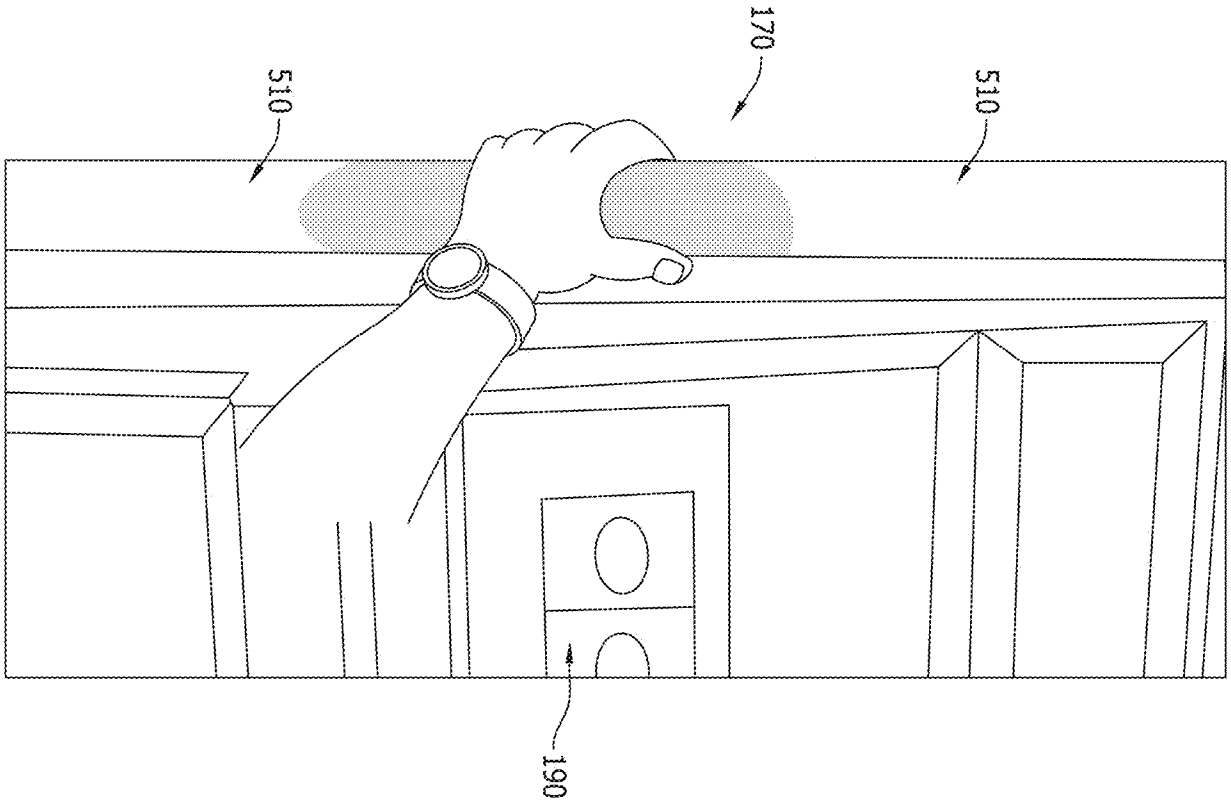
Figure 6:
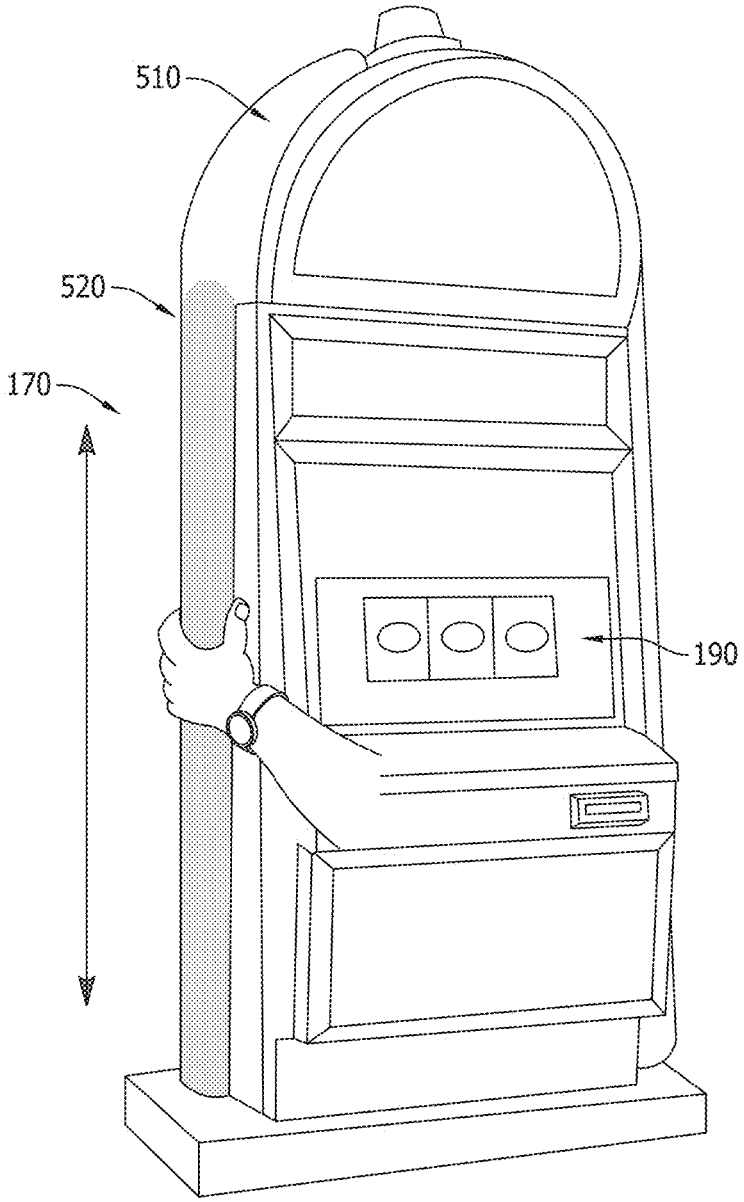
Figure 7:
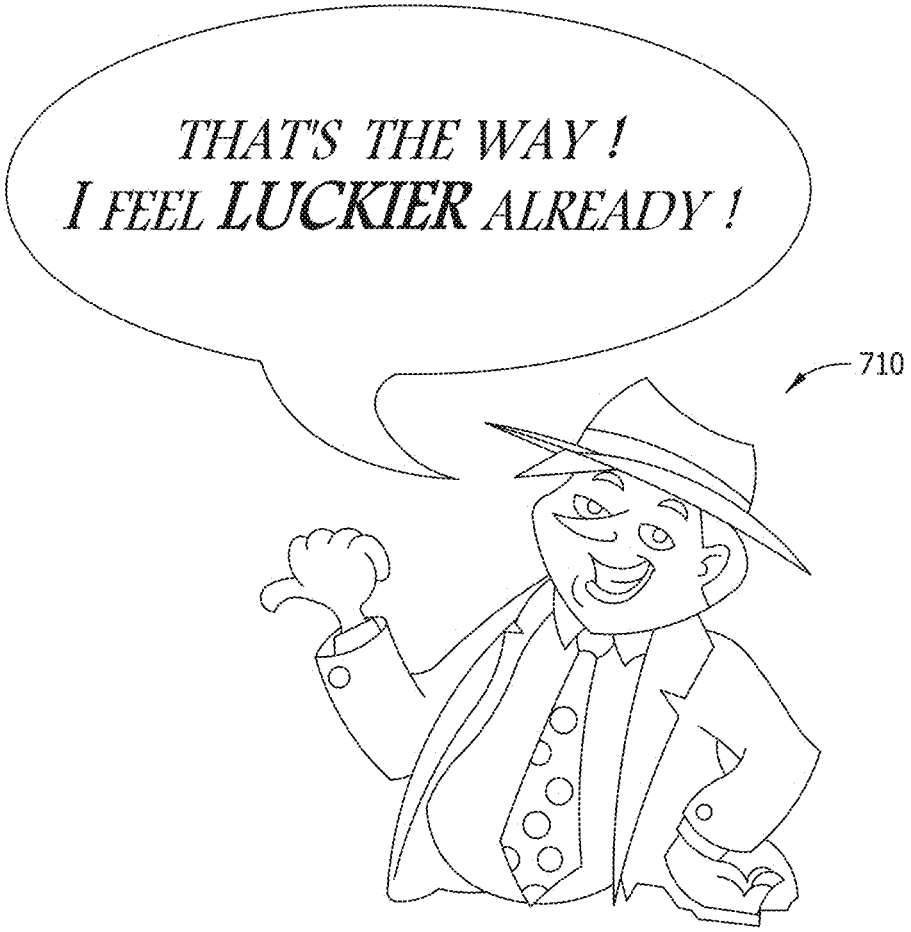
Figure 8:
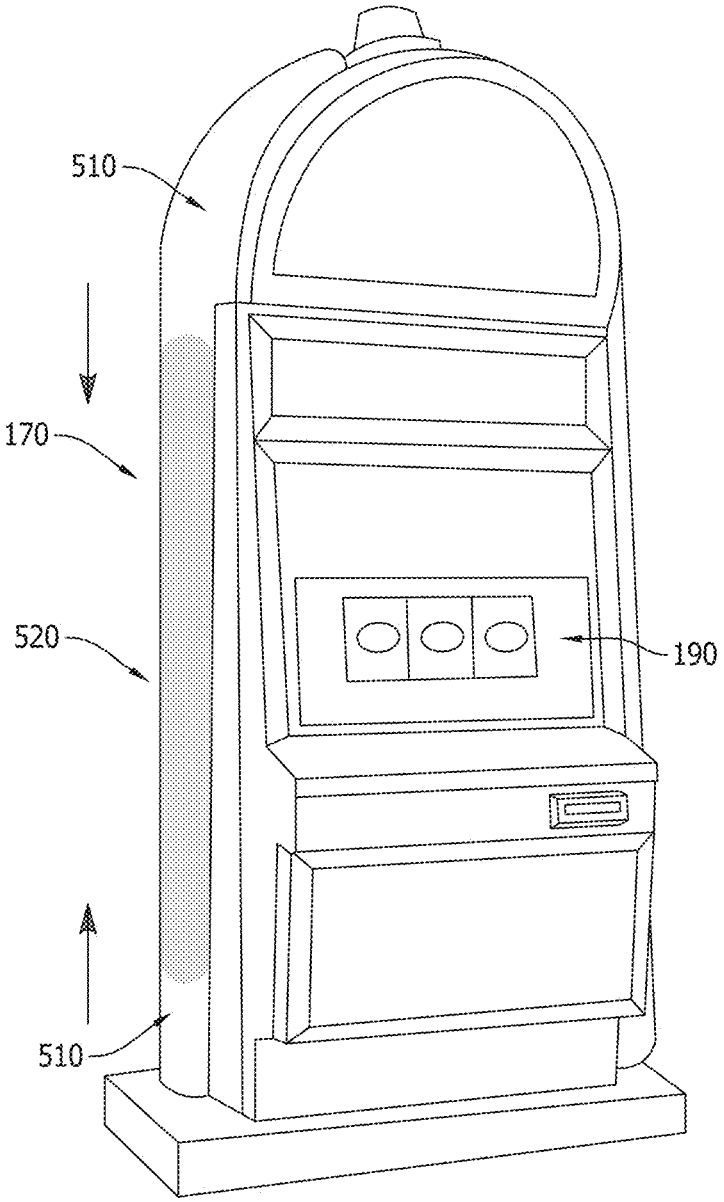
Figure 9:
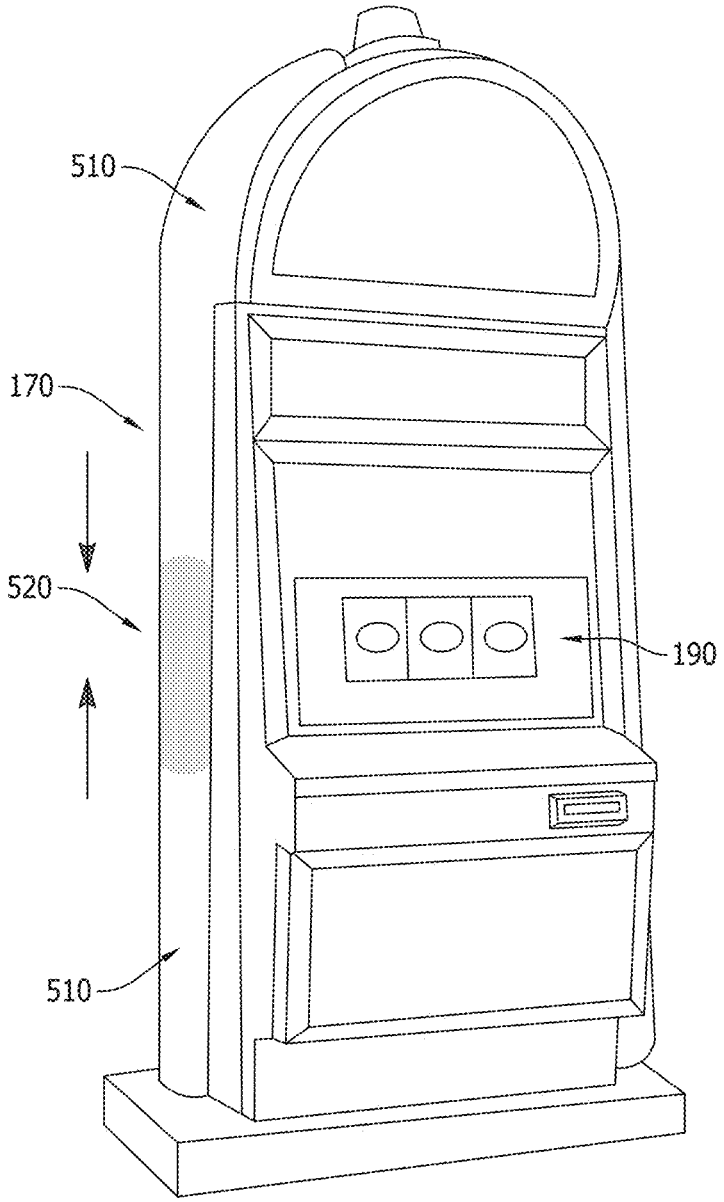
Figure 10:
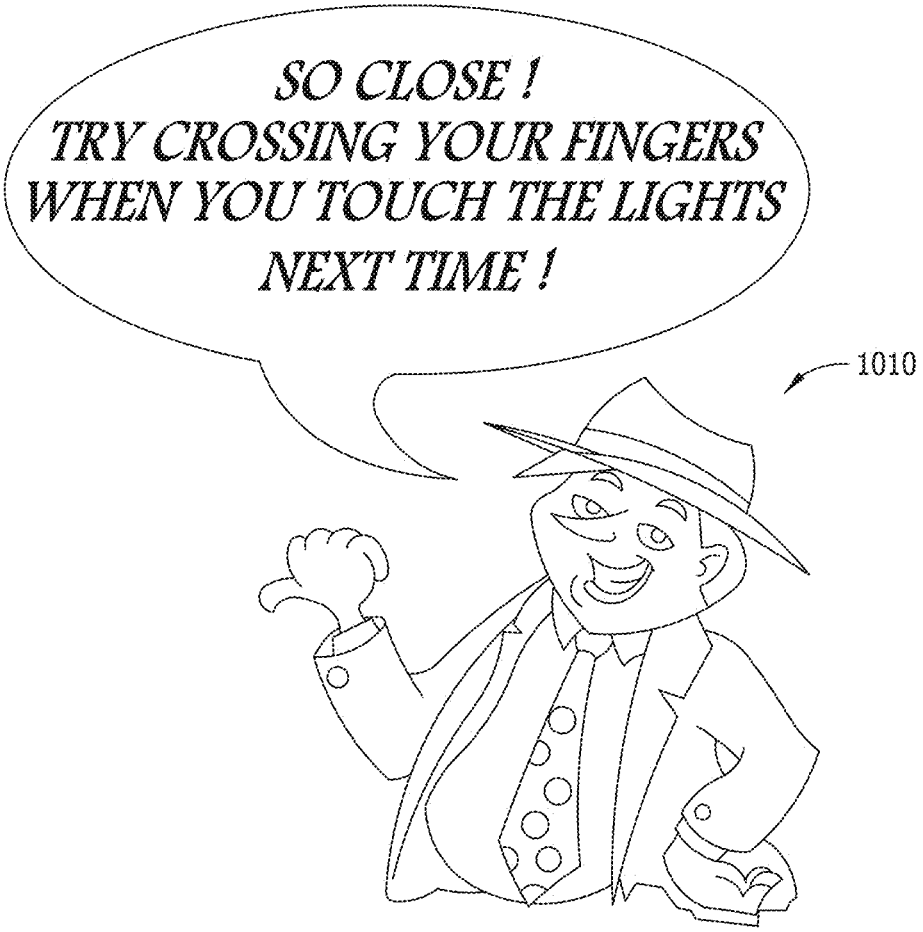

FIGS. 4, 7, and 10 are schematic diagrams of gaming system 100 at various stages of interaction with a player. FIGS. 5, 6, 8, and 9 are example images that may be shown on presentation device 190 at various stages of interaction with the player. In the example embodiment, presentation device 190 presents a message that prompts the player to interact with interactive device 170. For example, presentation device 190 may present an image 410 shown in FIG. 4 that includes the message, "Looks like you could use a little extra luck! Try touching the lights on the side and see what happens!" The example message encourages the player to increase his luck by touching and/or rubbing interactive device 170.

In the example embodiment, interactive device 170 is in a first configuration 510 (e.g., a first color) before the player interacts with interactive device 170. When the player begins interacting with interactive device 170 (e.g., touching interactive device 170, making noise), in the example embodiment, interactive device 170 presents feedback to the player. For example, as shown in FIG. 5, at least a portion of interactive device 170 is adjusted and/or changed from first configuration 510 to a second configuration 520 (e.g., a second color). As the interaction with interactive device 170 increases (e.g., longer duration, increased pressure, louder noise), the portion of interactive device 170 that is in second configuration 520 also increases. For example, as shown in FIG. 6, the longer the player holds, touches, and/or rubs interactive device 170, the more the portion of interactive device 170 that is in second configuration 520 expands. In at least some embodiments, a rate at which interactive device 170 is adjusted and/or changed from first configuration 510 to second configuration 520 is adjustable based on an interaction parameter (e.g., duration of interaction, pressure of interaction, speed of interaction, volume of interaction).

When a predetermined threshold (e.g., time, a predetermined portion of interactive device 170 in the first or second configuration 520) is satisfied, in the exemplary embodiment, interactive device 170 and/or presentation device 190 presents feedback to the user. For example, when the portion of interactive device 170 that is in second configuration 520 spans a predetermined portion (e.g., half) of interactive device 170 that is adjustable and/or changeable between first configuration 510 and second configuration 520, in the example embodiment, presentation device 190 may present a message, "I feel some luck coming your way!" In at least some embodiments, when the portion of interactive device 170 that is in second configuration 520 spans substantially a maximum portion of interactive device 170 that is adjustable and/or changeable between first configuration 510 and second configuration 520 (e.g., substantially no portion of interactive device 170 that is adjustable and/or changeable between first configuration 510 and second configuration 520 is in first configuration 510), the interactive device 170 remains in second configuration 520 for at least a predetermined amount of time. Additionally or alternatively, presentation device 190 may present an image 710 shown in FIG. 7 that includes the message, "That's the way! I feel luckier already!"

When the player stops interacting with interactive device 170 (e.g., does not touch interactive device 170, does not make noise), in the example embodiment, interactive device 170 presents feedback to the player. For example, as shown in FIG. 8, at least a portion of interactive device 170 is adjusted and/or changed from second configuration 520 to first configuration 510. As the absence of interaction with interactive device 170 increases (e.g., longer duration), the portion of interactive device 170 that is in first configuration 510 also increases. For example, as shown in FIGS. 8 and 9, the longer the player does not hold, touch, and/or rub interactive device 170, the more the portion of interactive device 170 that is in second configuration 520 recedes.

When a predetermined threshold (e.g., time, a predetermined portion of interactive device 170 in the first or second configuration 520) is satisfied, in the exemplary embodiment, interactive device 170 and/or presentation device 190 presents feedback to the user. For example, when the portion of interactive device 170 that is in first configuration 510 spans substantially a maximum portion of interactive device 170 that is adjustable and/or changeable between first configuration 510 and second configuration 520 (e.g., substantially no portion of interactive device 170 that is adjustable and/or changeable between first configuration 510 and second configuration 520 is in second configuration 520), the interactive device 170 remains in first configuration 510 for at least a predetermined amount of time and/or until the player interacts with interactive device 170. Additionally or alternatively, computing device 160 may determine and/or identify at least one gaming event (e.g., a loss), and presentation device 190 may present an image 1010 shown in FIG. 10 that includes the message, "So close! Try crossing your fingers when you touch the lights next time!"

Figure 11:
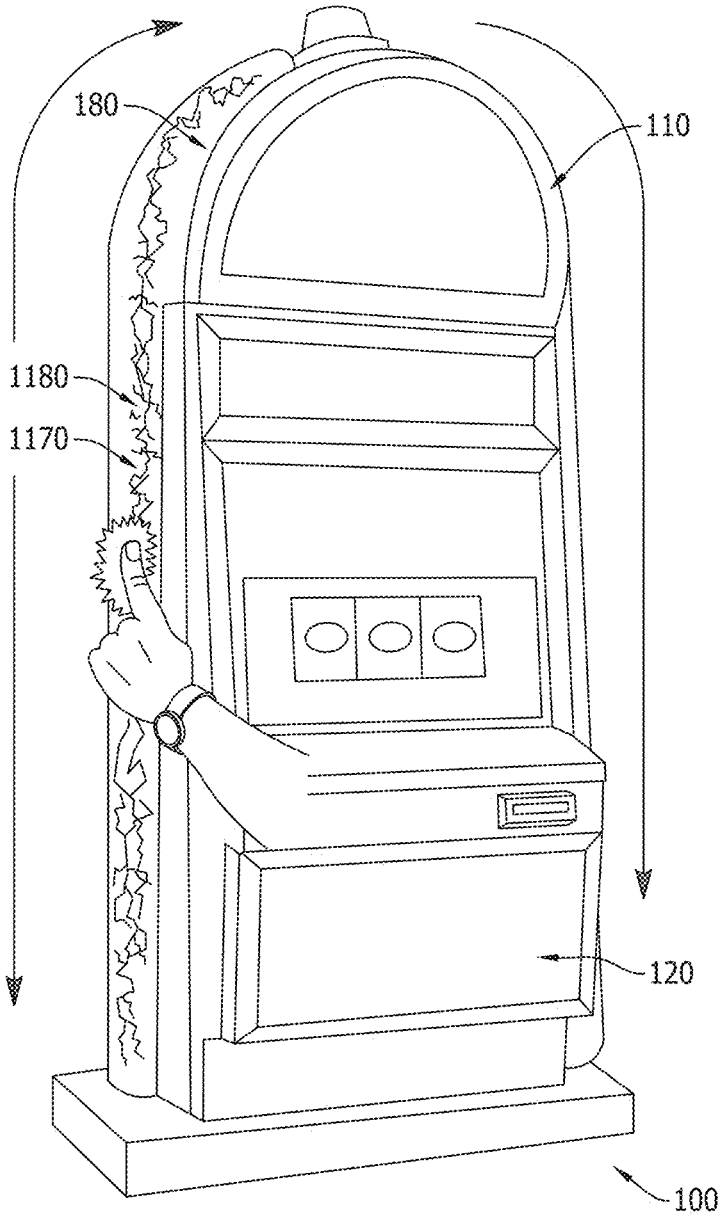

FIG. 11 is a schematic diagram of gaming machine 120 coupled to another interactive device 1170. Like interactive device 170, in the example embodiment, interactive device 1170 extends about at least portion 180 of the periphery of frame 110. Alternatively, interactive device 1170 may be coupled to and/or in any position with respect to any portion of frame 110 and/or gaming machine 120 that enables gaming system 100 to function as described herein.

In the example embodiment, interactive device 1170 is configured to function substantially similarly to interactive device 170. For example, in the example embodiment, interactive device 1170 is configured to be stimulated by an interaction of the player. In the example embodiment, interactive device 1170 is configured to be in and/or change towards a first configuration 510 (e.g., no light and/or solid light) (shown, for example, in FIG. 5) when the player does not interact with interactive device 170, and be in and/or change towards a second configuration 1180 (e.g., a lightning-shaped light) when the player interacts with interactive device 1170. Interactive device 1170 may be configured to detect any type of interaction and/or have any configuration that enables gaming system 100 to function as described herein.

The embodiments described herein facilitate interacting with a player of a gaming machine. The systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an example gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the example operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are example only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

The present disclosure uses examples to disclose the best mode and also to enable any person skilled in the art to practice the claimed subject matter, including making and using any devices or systems and performing any incorporated methods. The patentable scope of the present disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gaming system comprising:
- a frame;
- a presentation device;
- an interactive device including a visual presentation portion extending about at least a portion of a periphery of the frame;
- a game controller; and
- a memory storing instructions, which when executed, cause the game controller to at least:
  - present, via the presentation device, a first message prompting an audible interaction with the gaming system;
  - detect the audible interaction with the interactive device, the audible interaction including audible sounds;
  - determine an amount of audible interaction with the interactive device; and
  - control the interactive device to present visual feedback in response to determining that the amount of audible interaction with the interactive device satisfies a predetermined threshold,
    - wherein the visual feedback includes increasing a portion of the interactive device that is illuminated about the periphery of the frame in response an increasing amount of audible interaction with the interactive device, and
    - wherein the visual feedback includes reducing a portion of the interactive device that is illuminated about the periphery of the frame in response to a decreasing amount of audible interaction with the interactive device;
- determine that at least a predefined portion of the interactive device is illuminated about the periphery of the frame; and
- control the presentation device to present a second message in response to determining that the predefined portion of the interactive device is illuminated about the periphery of the frame, the second message encouraging continued audible interaction with the interactive device.

2. The gaming system of claim 1, wherein the instructions further cause the game controller to:
- switch the interactive device from a first configuration to a second configuration that is distinct from the first configuration when the amount of audible interaction satisfies the predetermined threshold.

3. The gaming system of claim 2, wherein the instructions further cause the game controller to:
- compare a portion of the interactive device that is in the second configuration to a predefined maximum portion for the interactive device; and
- maintain the second configuration for the interactive device for a predetermined amount of time based on a determination that the portion of the interactive device exceeds the predefined maximum portion.

4. The gaming system of claim 1, wherein the instructions further cause the game controller to adjust a rate at which the portion of the interactive device is illuminated about the periphery of the frame in response to the increasing amount of audible interaction with the interactive device, the rate further based upon an interaction parameter, the interaction parameter including at least one of a duration of the interaction and a volume of the interaction.

5. The gaming system of claim 1, wherein the instructions further cause the game controller to:

detect an absence of the audible interaction with the interactive device, and control at least one of the presentation device or the interactive device to present visual feedback based on the detection of the absence of the audible interaction with the interactive device, the feedback including at least one of reducing the portion of the interactive device that is illuminated about the periphery of the frame, or presenting, at the presentation device, a third message encouraging more audible interaction with the interactive device.

6. The gaming system of claim 1, wherein the interactive device is further configured for tactile interaction.

7. The gaming system of claim 1, wherein the instructions further cause the game controller to generate a gaming event, and control at least one of the presentation device and the interactive device to present visual feedback based on the generation of the gaming event.

8. A method for interacting with a wagering game using a gaming system including a presentation device, the method comprising:

presenting, at the presentation device, a first message prompting an audible interaction with the gaming system, the gaming system including an interactive device configured for audible interactivity and visual presentation;

detecting the audible interaction with the interactive device, the audible interaction including audible sounds;

determining an amount of audible interaction with the interactive device;

presenting, by the interactive device, visual feedback in response to determining that the amount of audible interaction with the interactive device satisfies a first predetermined threshold, wherein the visual feedback includes increasing a portion of the interactive device that is illuminated about the periphery of the frame in response to an increasing amount of audible interaction with the interactive device, and wherein the visual feedback includes reducing a portion of the interactive device that is illuminated about the periphery of the frame in response to a decreasing amount of audible interaction with the interactive device;

determining that at least a predefined portion of the interactive device is illuminated about the periphery of the frame; and presenting, at the presentation device, a second message in response to determining that the predefined portion of the interactive device is illuminated about the periphery of the frame, the second message encouraging continued audible interaction with the interactive device.

9. The method of claim 8, further comprising:

switching the interactive device from a first configuration to a second configuration that is distinct from the first configuration when the amount of audible interaction satisfies a second predetermined threshold;

comparing a portion of the interactive device that is in the second configuration to a predefined maximum portion for the interactive device; and maintaining the second configuration for the interactive device for a predetermined amount of time based on a determination that the portion of the interactive device exceeds the predefined maximum portion.

10. The method of claim 8, further comprising adjusting a rate at which the portion of the interactive device is illuminated about the periphery of the frame in response to the increasing amount of audible interaction with the interactive device, the rate further based upon an interaction parameter, the interaction parameter including at least one of a duration of the interaction and a volume of the interaction.

11. The method of claim 8 further comprising:

detecting, at the interactive device, an absence of the audible interaction with the interactive device; and presenting, by at least one of the presentation device or the interactive device, visual feedback based on the detection of the absence of the audible interaction with the interactive device, the visual feedback including at least one of reducing the portion of the interactive device that is illuminated about the periphery of the frame, or presenting, at the presentation device, a third message encouraging additional audible interaction with the interactive device.

12. The method of claim 8, wherein the interactive device is further configured for tactile interaction.

13. The method of claim 8 further comprising:

generating, at the gaming system, a gaming event; and presenting, by at least one of the presentation device and the interactive device, visual feedback based on the generation of the gaming event.

14. One or more non-transitory computer-readable storage media having computer-executable instructions embodied thereon, wherein, when executed by at least one processor, the computer-executable instructions cause the at least one processor to at least:

control a presentation device of a gaming system to present a first message configured to prompt an audible interaction with an interactive device, the interactive device is configured for audible interactivity and visual presentation, the interactive device including a visual presentation portion extending about at least a portion of a periphery of a frame of the gaming system;

detect the audible interaction with the interactive device, the audible interaction including audible sounds;

determine an amount of audible interaction with the interactive device;

control the interactive device to present feedback in response to determining that the amount of audible interaction with the interactive device satisfies a first predetermined threshold, wherein the visual feedback includes increasing a portion of the interactive device that is illuminated about the periphery of the frame in response to an increasing amount of audible interaction with the interactive device, and wherein the visual feedback includes reducing a portion of the interactive device that is illuminated about the periphery of the frame in response to a decreasing amount of audible interaction with the interactive device;

determine that at least a predefined portion of the interactive device is illuminated about the periphery of the frame; and control the presentation device to present a second message in response to determining that the predefined portion of the interactive device is illuminated about the periphery of the frame, the second message encouraging continued audible interaction with the interactive device.

15. The one or more non-transitory computer-readable storage media of claim 14, wherein the computer-executable instructions further cause the at least one processor to:

switch the interactive device from a first configuration to a second configuration that is distinct from the first configuration when the amount of audible interaction satisfies a second predetermined threshold.

16. The one or more non-transitory computer-readable storage media of claim 15, wherein the computer-executable instructions further cause the at least one processor to:

compare a portion of the interactive device that is in the second configuration to a predefined maximum portion for the interactive device; and maintain the second configuration for the interactive device for a predetermined amount of time based on a determination that the portion of the interactive device exceeds the predefined maximum portion.

17. The one or more non-transitory computer-readable storage media of claim 14, wherein the computer-executable instructions further cause the at least one processor to adjust a rate at which the portion of the interactive device is illuminated about the periphery of the frame in response to the increasing amount of audible interaction with the interactive device, the rate further based upon an interaction parameter, the interaction parameter including at least one of a duration of the interaction and a volume of the interaction.

18. The one or more non-transitory computer-readable storage media of claim 14, wherein the computer-executable instructions further cause the at least one processor to:

detect an absence of the audible interaction with the interactive device; and present, on at least one of the presentation device and the interactive device, visual feedback based on the detection of the absence of the audible interaction with the interactive device, the feedback including at least one of reducing the portion of the interactive device that is illuminated about the periphery of the frame, or presenting, at the presentation device, a third message encouraging additional audible interaction with the interactive device.

19. The one or more non-transitory computer-readable storage media of claim 14, wherein the computer-executable instructions further cause the at least one processor to detect tactile interaction with the interactive device.

20. The one or more non-transitory computer-readable storage media of claim 14, wherein the computer-executable instructions further cause the at least one processor to:

generate a gaming event; and present, on at least one of the presentation device and the interactive device, visual feedback based on the generation of the gaming event.

* * * * *